US009587462B2

(12) United States Patent
Giusti, Jr. et al.

(10) Patent No.: US 9,587,462 B2
(45) Date of Patent: Mar. 7, 2017

(54) SAFETY VALVE SYSTEM FOR CABLE DEPLOYED ELECTRIC SUBMERSIBLE PUMP

(75) Inventors: Frank Giusti, Jr., Pilot Point, TX (US); James D. Vick, Jr., Dallas, TX (US); Leo G. Collins, Farmers Branch, TX (US); Tom W. Swan, Parker, TX (US); Gary L. Stephenson, Carrollton, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 418 days.

(21) Appl. No.: 14/122,088

(22) PCT Filed: May 21, 2012

(86) PCT No.: PCT/US2012/038881

§ 371 (c)(1),
(2), (4) Date: Nov. 25, 2013

(87) PCT Pub. No.: WO2012/166418

PCT Pub. Date: Dec. 6, 2012

(65) Prior Publication Data

US 2014/0096978 A1 Apr. 10, 2014

Related U.S. Application Data

(60) Provisional application No. 61/490,979, filed on May 27, 2011.

(51) Int. Cl.
*E21B 34/14* (2006.01)
*E21B 43/12* (2006.01)
(Continued)

(52) U.S. Cl.
CPC ..... *E21B 34/066* (2013.01); *E21B 17/1035* (2013.01); *E21B 34/06* (2013.01)

(58) Field of Classification Search
CPC .... E21B 34/105; E21B 34/106; E21B 34/107; E21B 34/12; E21B 34/14; E21B 43/128
(Continued)

(56) References Cited

U.S. PATENT DOCUMENTS 3,897,825 A * 8/1975 Tausch ..... E21B 34/12 137/496
4,392,377 A * 7/1983 Rankin ..... E21B 34/14 250/254

(Continued)

FOREIGN PATENT DOCUMENTS

WO 2012166418 A2 12/2012
WO 2012166418 A3 12/2012

OTHER PUBLICATIONS

Filing receipt and specification for provisional patent application entitled "Safety Valve System for Cable Deployed Electric Submersible Pump," by Frank Giusti, Jr., et al., filed May 27, 2011 as U.S. Appl. No. 61/490,979.

(Continued)

*Primary Examiner* — Kenneth L Thompson
(74) *Attorney, Agent, or Firm* — Scott Richardson; Baker Botts L.L.P.

(57) ABSTRACT

A safety valve system for downhole use in a wellbore comprises a safety valve comprising a sealable flow path; an annulus safety valve configured to provide fluid communication between a central flow path and an annular flow path; a landing nipple, wherein the landing nipple comprises ports configured to provide fluid communication between the annular flow path and the central flow path; and a cable passing through the sealable flow path, wherein the cable comprises a sealing mechanism and latch mechanism configured to engage the landing nipple.

14 Claims, 9 Drawing Sheets

(51) Int. Cl.
*E21B 34/06* (2006.01)
*E21B 17/10* (2006.01)

(58) Field of Classification Search
USPC ..... 166/68, 66.4, 106, 242.6, 373, 316, 319, 166/332.1, 334.1, 334.4, 285, 242.2
See application file for complete search history.

(56) References Cited

U.S. PATENT DOCUMENTS

| | | | | |
|---|---|---|---|---|
| 4,678,035 | A * | 7/1987 | Goldschild | E21B 23/006 166/240 |
| 5,167,278 | A * | 12/1992 | Goldschild | E21B 34/14 166/113 |
| 5,348,492 | A | 9/1994 | Sonnet | |
| 5,479,989 | A * | 1/1996 | Shy | E21B 34/06 166/332.4 |
| 6,196,325 | B1 | 3/2001 | Connell et al. | |
| 6,352,119 | B1 * | 3/2002 | Patel | E21B 23/006 166/332.2 |
| 6,533,039 | B2 | 3/2003 | Rivas et al. | |
| 7,195,072 | B2 | 3/2007 | MacKay et al. | |
| 8,863,849 | B2 * | 10/2014 | Patel | E21B 34/06 166/319 |

OTHER PUBLICATIONS

Foreign communication from a related counterpart application—International Search Report and Written Opinion, PCT/US2012/038881, Jan. 2, 2013, 11 pages.

* cited by examiner

SAFETY VALVE SYSTEM FOR CABLE DEPLOYED ELECTRIC SUBMERSIBLE PUMP

CROSS-REFERENCE TO RELATED APPLICATIONS

This application is a filing under 35 U.S.C. 371 of International Application No. PCT/US2012/038881 filed May 21, 2012, entitled "Safety Valve System for Cable Deployed Electric Submersible Pump," which claims priority to U.S. Provisional Application No. 61/490,979 filed on May 27, 2011 to Giusti et al., and entitled "Safety Valve System for Cable Deployed Electric Submersible Pump," which applications are incorporated herein by reference in their entirety.

STATEMENT REGARDING FEDERALLY SPONSORED RESEARCH OR DEVELOPMENT

Not applicable.

REFERENCE TO A MICROFICHE APPENDIX

Not applicable.

BACKGROUND

Wellbores are sometimes drilled into subterranean formations containing hydrocarbons to allow for recovery of the hydrocarbons. During the drilling and production of a hydrocarbon bearing formation, various procedures may be performed that involve temporarily isolating fluid flowing between the surface of a wellbore and the formation through a wellbore tubular. Such procedures can include flow control operations, completion operations, and/or interventions. The isolation of the wellbore typically involves the use of a mechanical component being disposed in the flow path to provide a seal. Any additional components disposed within the flow path may interfere with the ability of the mechanical components to form a seal, thereby preventing the isolation of the wellbore as needed.

SUMMARY

In an embodiment, a safety valve system for downhole use in a wellbore comprises a safety valve comprising a sealable flow path; an annulus safety valve configured to provide fluid communication between a central flow path and an annular flow path; a landing nipple, wherein the landing nipple comprises ports configured to provide fluid communication between the annular flow path and the central flow path; and a cable passing through the sealable flow path, wherein the cable comprises a sealing mechanism and latch mechanism configured to engage the landing nipple. The annular flow path may comprise a flow path between an outer wellbore tubular and the work string. The safety valve may be disposed below the annulus safety valve, or the landing nipple may be coupled to the annulus safety valve. The cable may comprise an electric line, and the cable may be electrically coupled to a power source at a surface of the wellbore. The safety valve system may also include an electric submersible pump coupled to the cable. The safety valve may comprise a sealing element, and wherein the sealing element may comprise a flapper for engaging a corresponding flapper seal, a ball for engaging a ball valve seat, a gate for engaging a gate valve seat, or a sleeve slidingly disposed within a window.

In an embodiment, a safety valve system for downhole use in a wellbore comprises a safety valve comprising a sealable flow path; a landing nipple comprising a locking profile; an annulus safety valve engaging the locking profile; and an annulus safety valve control line coupled to the annulus safety valve. The safety valve system may also include a cable passing through the sealable flow path and the annulus safety valve, where the cable may comprise a sealing mechanism and latch mechanism configured to sealingly engage the annulus safety valve. The landing nipple may be coupled to the annulus safety valve. The annulus safety valve may comprise an annulus safety valve latch mechanism for engaging the locking profile, and the an annulus safety valve latch mechanism may be configured to engage the locking profile responsive to a weight, an impact, a hydraulic force, a longitudinal motion, a rotational motion, or any combination thereof. The safety valve system may also include an annulus safety valve control line coupled to the annulus safety valve. The annulus safety valve may be configured to provide fluid communication from the central flow path, through the annulus safety valve, and back into the central flow path when a control pressure is supplied through the annulus safety valve control line.

In an embodiment, a method comprises disposing a cable within a wellbore tubular string disposed in a well, wherein the wellbore tubular string comprises: a safety valve comprising a sealable flow path; an annulus safety valve configured to provide fluid communication between a central flow path and an annular flow path; and a landing nipple, wherein the landing nipple comprises ports configured to provide fluid communication between the annular flow path and the central flow path, and wherein the cable comprises a sealing mechanism and latch mechanism configured to engage the landing nipple; and producing a fluid from the wellbore. Producing the fluid from the wellbore may comprise passing the fluid through the central flow path, through the annulus safety valve, through the annular flow path, through the ports, and through the central flow path to the surface of the wellbore. The method may also include coupling an electric submersible pump to the cable. The landing nipple may also include a landing shoulder and a latching indicator, and the latching mechanism may engages the landing shoulder and the latching indicator of the landing nipple. The method may also include isolating a first portion of the wellbore above the annulus safety valve from a second portion of the wellbore below the annulus safety valve.

These and other features will be more clearly understood from the following detailed description taken in conjunction with the accompanying drawings and claims.

BRIEF DESCRIPTION OF THE DRAWINGS

For a more complete understanding of the present disclosure and the advantages thereof, reference is now made to the following brief description, taken in connection with the accompanying drawings and detailed description.

DETAILED DESCRIPTION OF THE EMBODIMENTS

Figure 1:
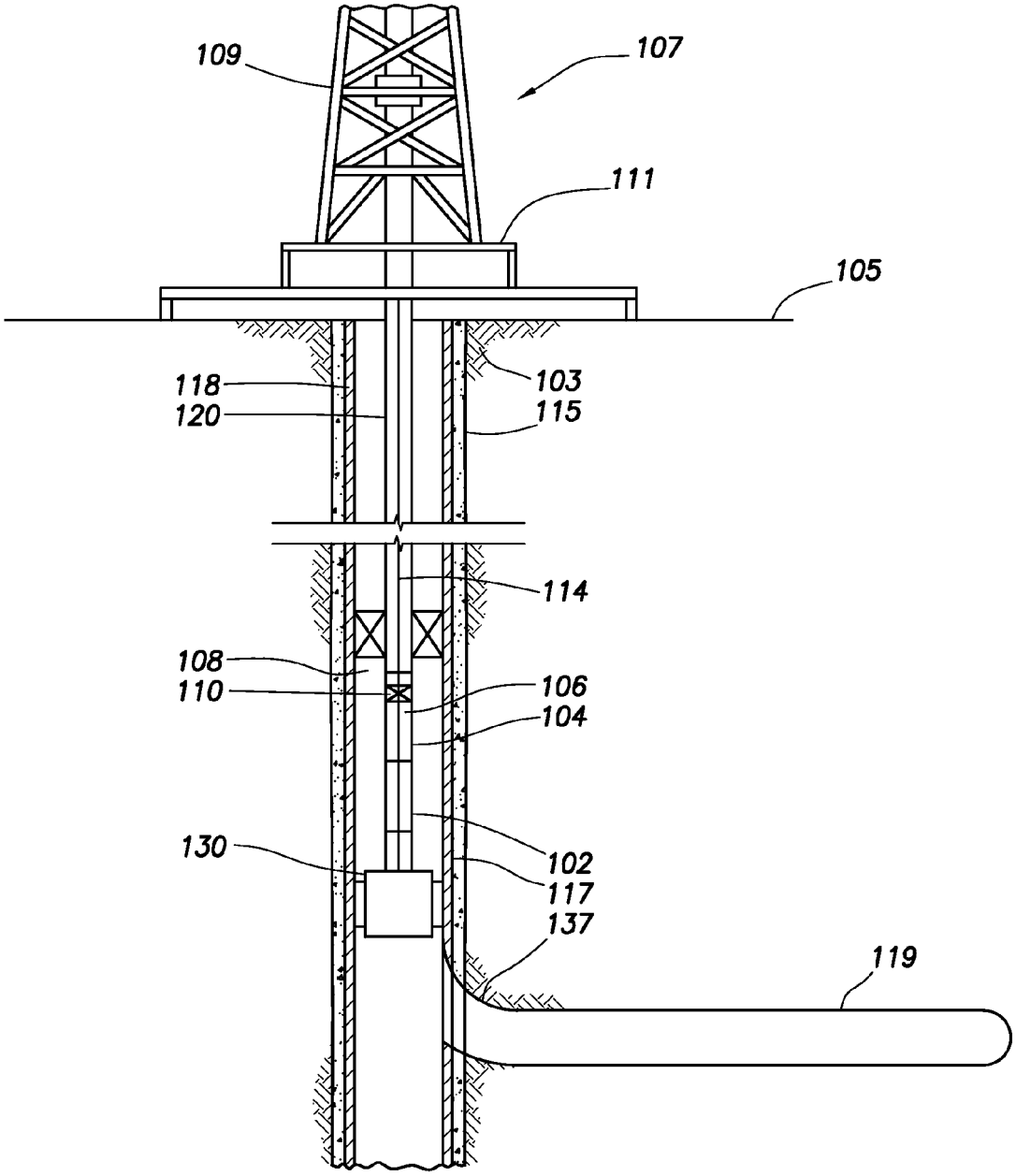
FIG. 1 is a schematic view of an embodiment of a subterranean formation and wellbore operating environment.

In the drawings and description that follow, like parts are typically marked throughout the specification and drawings with the same reference numerals, respectively. The drawing figures are not necessarily to scale. Certain features of the invention may be shown exaggerated in scale or in somewhat schematic form and some details of conventional elements may not be shown in the interest of clarity and conciseness. Specific embodiments are described in detail and are shown in the drawings, with the understanding that the present disclosure is to be considered an exemplification of the principles of the invention, and is not intended to limit the invention to that illustrated and described herein. It is to be fully recognized that the different teachings of the embodiments discussed infra may be employed separately or in any suitable combination to produce desired results.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". Reference to up or down will be made for purposes of description with "up," "upper," "upward," or "upstream" meaning toward the surface of the wellbore and with "down," "lower," "downward," or "downstream" meaning toward the terminal end of the well, regardless of the wellbore orientation. The term "zone" or "pay zone" as used herein refers to separate parts of the wellbore designated for treatment or production and may refer to an entire hydrocarbon formation or separate portions of a single formation such as horizontally and/or vertically spaced portions of the same formation. The various characteristics mentioned above, as wellbore as other features and characteristics described in more detail below, will be readily apparent to those skilled in the art with the aid of this disclosure upon reading the following detailed description of the embodiments, and by referring to the accompanying drawings.

A safety valve may be employed within a wellbore or a wellbore tubular string to enable the flow of fluids from within the wellbore to be isolated during use. Various electrical components can be used within wellbores that require an electrical connection in order to function. When the electrical connection (e.g., a cable) passes through a safety valve, the sealable path may be blocked, thereby preventing the safety valve from forming a seal and isolating the flow of fluids within the wellbore. The safety valve system described herein allows a safety valve function to be maintained even while using a cable deployed downhole tool such as an electrical component deployed below the safety valve.

Turning to FIG. 1, an example of a wellbore operating environment is shown. As depicted, the operating environment comprises a drilling rig 107 that is positioned on the earth's surface 105 and extends over and around a wellbore 115 that penetrates a subterranean formation 103 for the purpose of recovering hydrocarbons. The wellbore 115 may be drilled into the subterranean formation 103 using any suitable drilling technique. The wellbore 115 extends substantially vertically away from the earth's surface 105 over a vertical wellbore portion 117, deviates from vertical relative to the earth's surface 105 over a deviated wellbore portion 137, and transitions to a horizontal wellbore portion 119. In alternative operating environments, all or portions of a wellbore may be vertical, deviated at any suitable angle, horizontal, and/or curved. The wellbore may be a new wellbore, an existing wellbore, a straight wellbore, an extended reach wellbore, a sidetracked wellbore, a multilateral wellbore, and other types of wellbores for drilling and completing one or more production zones. Further the wellbore may be used for both producing wells and injection wells. In an embodiment, the wellbore may be used for purposes other than or in addition to hydrocarbon production, such as uses related to geothermal energy and/or the production of water (e.g., potable water).

A wellbore tubular string 120 including a work string comprising the safety valve system as described herein may be lowered into the subterranean formation 103 for a variety of drilling, completion, production, workover, and/or treatment procedures throughout the life of the wellbore. The embodiment shown in FIG. 1 illustrates the wellbore tubular 120 in the form of a completion and/or work string being lowered into the subterranean formation. It should be understood that the wellbore tubular 120 is equally applicable to any type of wellbore tubular being inserted into a wellbore, including as non-limiting examples drill pipe, production tubing, rod strings, and coiled tubing. In the embodiment shown in FIG. 1, the wellbore tubular 120 comprising the safety valve system may be conveyed into the subterranean formation 103 in a conventional manner.

As described in more detail herein, the safety valve system for use in the wellbore 115 may comprise a safety valve 102 comprising a sealable flow path, an annulus safety valve 104 configured to provide fluid communication between a central flow path 106 and an annular flow path 108, a landing nipple 110, wherein the landing nipple 110 comprises ports configured to provide fluid communication between the annular flow path 108 and the central flow path 106, and a cable 114 passing through the sealable flow path of the safety valve 102. The cable 114 comprises a sealing mechanism and latch mechanism configured to engage the landing nipple 110. The annular flow path 108 may comprise a flow path between an outer wellbore tubular 118 (e.g., the casing, the wellbore 115 wall, an outer production tubing, etc.) and the work string 120. The cable may provide an electrical coupling to a downhole component 130 (e.g., an electric submersible pump, electrical valve, etc.).

The drilling rig 106 comprises a derrick 108 with a rig floor 110 through which the wellbore tubular 120 extends downward from the drilling rig 106 into the wellbore 115. The drilling rig 106 comprises a motor driven winch and other associated equipment for extending the wellbore tubular 120 into the wellbore 115 to position the wellbore tubular 120 at a selected depth. While the operating environment depicted in FIG. 1 refers to a stationary drilling rig 106 for lowering and setting the wellbore tubular 120 comprising the running tool within a land-based wellbore 115, in alternative embodiments, mobile workover rigs, wellbore servicing units (such as coiled tubing units), and the like may be used to lower the wellbore tubular 120 comprising the running tool into a wellbore. It should be understood that a wellbore tubular 120 comprising the running tool may alternatively be used in other operational environments, such as within an offshore wellbore operational environment. In alternative operating environments, a vertical, deviated, or horizontal wellbore portion may be cased and cemented and/or portions of the wellbore may be uncased.

Regardless of the type of operational environment in which the safety valve system is used, it will be appreciated that the safety valve system allows a safety valve function to be maintained even while using a cable deployed downhole tool such as an electrical component deployed below the safety valve. In an embodiment, the safety valve function is maintained through the safety valve 102 when the cable 114 is not disposed within the central flow path 106, and the safety valve function is maintained through the combination of the annulus safety valve 104 and the landing nipple 110 when the cable is disposed within the central flow path 106.

Figure 2A:
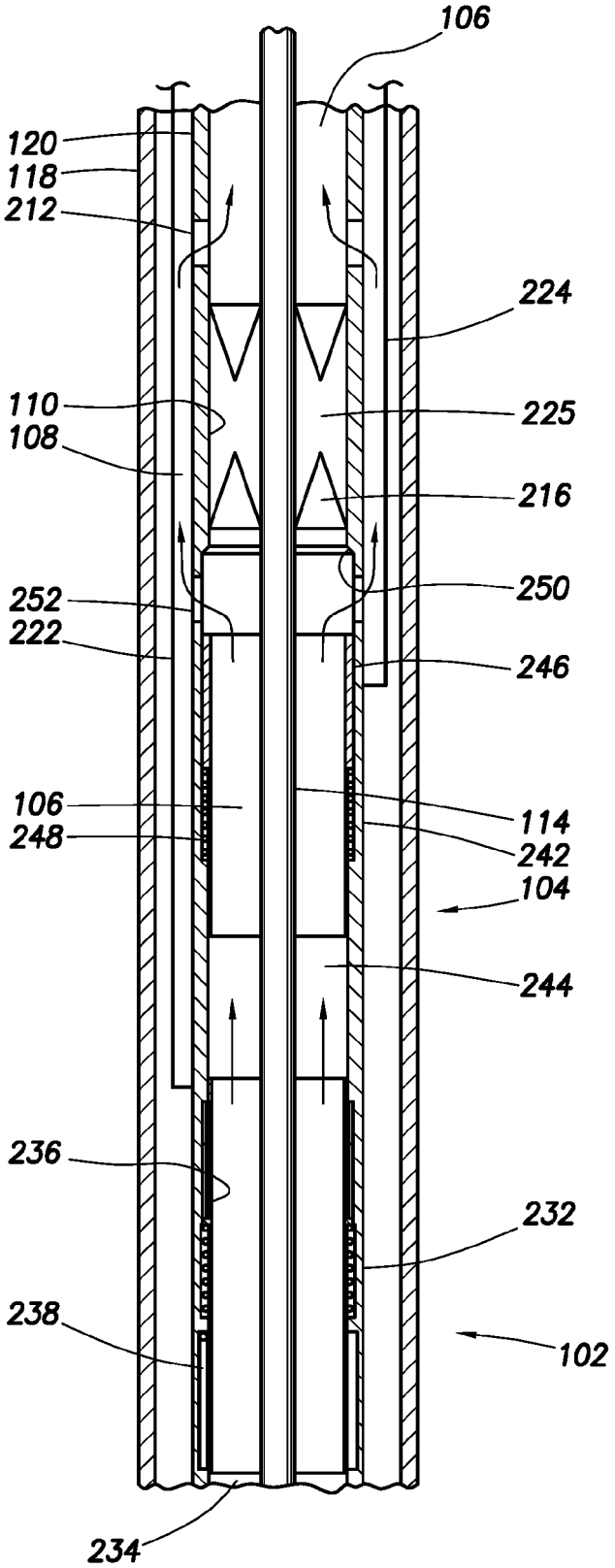
FIG. 2A is a cross-section of a safety valve system according to an embodiment.
Figure 2B:
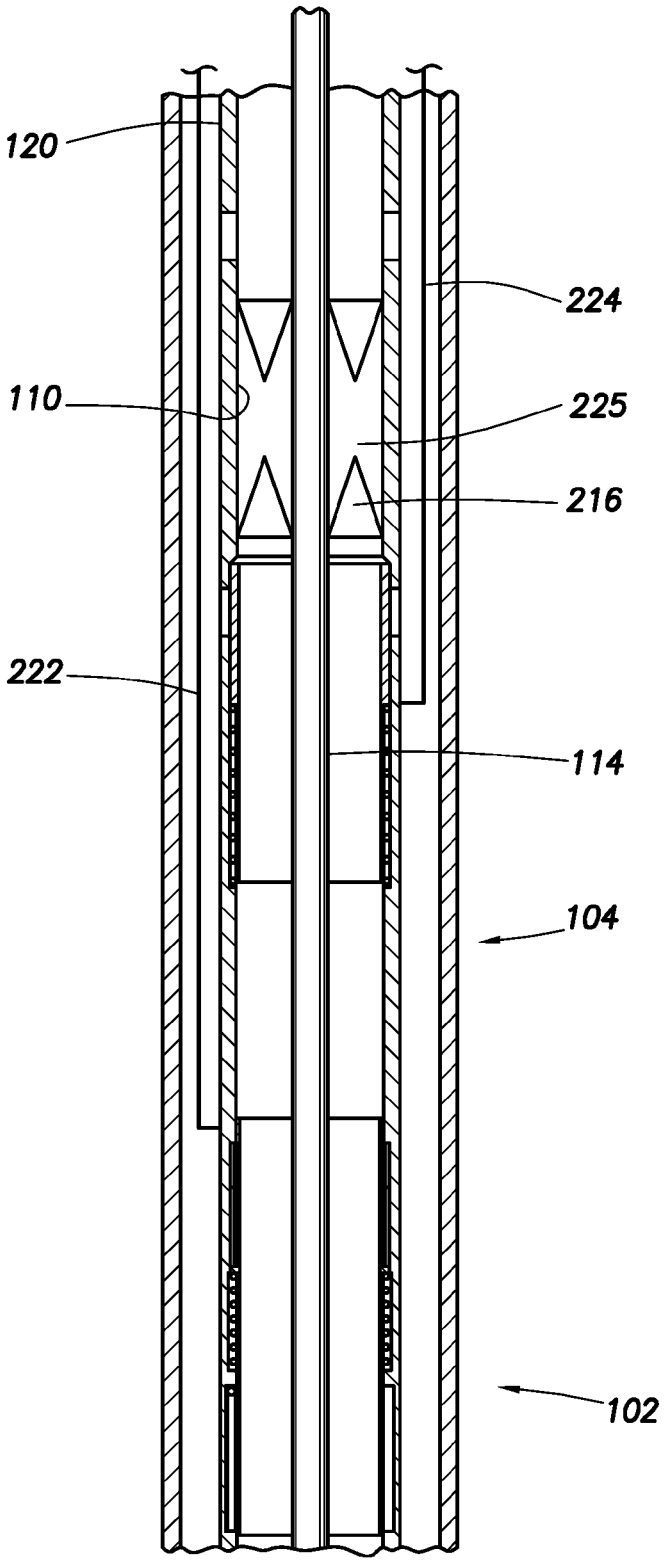
FIG. 2B is a cross-section of a safety valve system according to an embodiment.
Figure 2C:
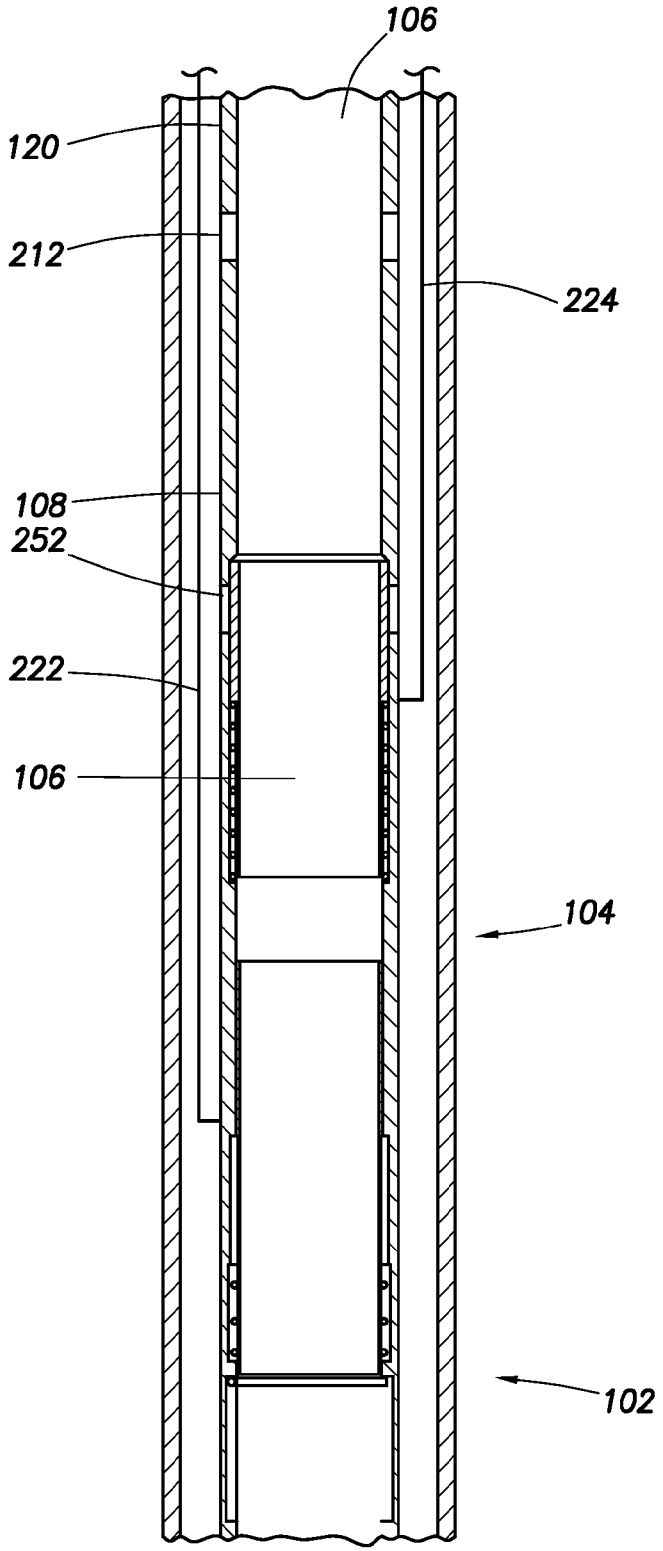
FIG. 2C is a cross-section of a safety valve system according to an embodiment.

FIGS. 2A-2C illustrate a schematic close up view of the safety valve system illustrated in FIG. 1. In an embodiment, the safety valve 102 may comprise any conventional safety valve known in the art that comprises a sealable flow path. The safety valve 102 may comprise a sealing element for isolating flow through the sealable flow path. The sealing element may be configured to substantially block the flow of fluid through the central flow path 106. For example, the sealing element may comprise a flapper for engaging a corresponding flapper seal, a ball for engaging a ball valve seat, a gate for engaging a gate valve seat, or a sleeve slidingly disposed within a window.

In an embodiment, the safety valve comprises a flapper-type safety valve as illustrated in FIGS. 2A-2C. A flapper-type safety valve 102 generally comprises a tubular body member 232 with a longitudinal bore 234, which may form a portion of the central flow path 106, that extends therethrough. An actuator 236, usually referred to as a flow tube, may be disposed within the body member 232 and is configured to longitudinally translate between the open position of the valve and the closed position of the valve within the body member 232. A biasing member such as a spring 233 may be disposed about the actuator 236 act upon the actuator 236, thereby biasing the actuator 236 away from a closure member 238, which is usually referred to as a flapper. The closure member 238 is pivotably mounted via a hinge within the body member 232 to control fluid flow through the longitudinal bore 234. In an embodiment, a rod-piston system, or other hydraulic operating piston, such as an annular piston may be provided to controllably translate the actuator 236 within the longitudinal bore 234, and to actuate the closure member 238 between an open position and a closed position and/or a closed position and an open position. The safety valve 102 may generally comprise a control line inlet that can be connected to a control line 222 and provide a control fluid to the piston. Once connected, the control line 222 is configured to be in fluid communication with a piston disposed within a piston rod chamber. A first end of the piston may be in contact with hydraulic fluid provided thereto through the control line 222. A second end of the piston is operatively connected, in any suitable manner, to the actuator 236. When the pressure of hydraulic fluid in the control line 222 exceeds the force needed to compress the biasing member, the piston is forced downwardly, thereby causing the actuator 236 to come into contact with, and open, the closure member 238. In the event that the hydraulic pressure applied to the piston is decreased, the biasing member forces the actuator 236 upwardly away from the closure member 238. The closure member 238 is then rotated, and biased, into a closed position by action of a hinge spring to a normally closed position to prevent fluid flow into the actuator 236 and through the longitudinal bore 234. When the cable 114 is disposed within the longitudinal bore 234, the closure member 238 may be prevented from fully rotating into the closed position, thereby preventing a seal from being formed through the safety valve 102.

In an embodiment, the safety valve 102 may comprise a ball valve. A ball valve generally comprises a variety of components to provide a seal (e.g., a ball/seat interface) and actuate a ball disposed within a body of the valve. A ball valve assembly may comprise cylindrical retaining members disposed on opposite sides of the ball. One or more seats or seating surfaces may be disposed above and/or below the ball to provide a fluid seal with the ball. The ball generally comprises a truncated sphere having planar surfaces on opposite sides of the sphere. Planar surfaces may each have a spigot comprising a projection (e.g., cylindrical projections) extending outwardly therefrom, and a radial groove extending from the spigots to the edge of the planar surface. An actuation member having two parallel arms may be positioned about the ball and the retaining members. The spigots may be received in windows through each of the arms. Actuation pins may be provided on each of the inner sides of the arms, and the pins may be received within the grooves on the ball. In the open position, the ball is positioned so as to allow the flow of fluid through the ball valve by allowing fluid to flow through an interior fluid passageway (e.g., a bore or hole) extending through the ball. The interior flow passage may have its longitudinal axis disposed at about 90 degrees to the longitudinal axis when the ball is in the closed position, and the interior flow passage may have its longitudinal axis substantially aligned with the longitudinal axis when the ball is in the open position The ball may be rotated by linear movement of the actuation member along the longitudinal axis. The pins move as the actuation member moves, causing the ball to rotate due to the positioning of the pins within the grooves on the ball. During operation, the ball is actuated from an open position to a closed position by rotating the ball such that the interior flow passage is rotated out of alignment with the flow of fluid, thereby forming a fluid seal with one or more seats or seating surfaces and closing the valve. Similarly, the ball is actuated from a closed position to an open position by rotating the ball such that the interior flow passage is rotated into alignment with the flow of fluid. When the cable 114 is disposed within the longitudinal bore through the safety valve 102, the ball may be prevented from fully rotating into the closed position, thereby preventing a seal from being formed through the safety valve 102.

The safety valve system also comprises an annulus safety valve 104. In an embodiment, the annulus safety valve 104 may comprise any annulus safety valve known in the art that is configured to provide a sealable flow path between a central flow path 106 and an annular flow path 108. The annulus safety valve 104 may comprise a sealing element for isolating (e.g., opening or closing) flow through the sealable flow path. The sealing element may be configured to substantially block the flow of fluid between the central flow path 106 and the annular flow path 108. For example, the sealing element may comprise a sleeve and/or piston slidingly disposed within a window, where the window may have one or more ports and/or be disposed adjacent one or more ports.

In an embodiment as illustrated in FIGS. 2A-2C, the annulus safety valve 104 comprises a generally tubular housing 242 with a longitudinal bore 244, which may form a portion of the central flow path 106, that extends therethrough. A piston 246 may be sealingly disposed within the housing 242 and may be configured to longitudinally translate between the open position of the valve and the closed position of the valve within the housing 242. A biasing member 248 such as a spring may be disposed about the piston 246 and act upon the piston 246, thereby biasing the piston 246 into a sealing engagement with a surface 250 of the housing 242. One or more ports 252 are disposed in the housing 242 to provide a fluid pathway between the longitudinal bore 244 forming a portion of the central flow path 106 and the annular flow path 108. In an embodiment, a rod-piston system, or other hydraulic operating piston, such as an annular piston may be provided to controllably translate the piston 246 within the longitudinal bore 244. The annulus safety valve 104 may generally comprise a control line inlet that can be connected to a control line 224 and provide a control fluid to the piston 246. A first end of the piston may be in contact with hydraulic fluid provided thereto through the control line 224. When the pressure of hydraulic fluid in the control line 224 exceeds the force needed to compress the biasing member 248, the piston 246 is forced downwardly, thereby translating the piston 246 away from the surface 250 of the housing 242 to expose the one or more ports 252. In the event that the hydraulic pressure applied to the piston 246 is decreased, the biasing member 248 forces the piston 246 upwardly to sealingly engage the surface 250, thereby closing the annulus safety valve 104 and substantially preventing fluid flow through the one or more ports 252.

The landing nipple 110 may form a portion of the safety valve system and may include a landing shoulder and a latching indicator. The landing shoulder and latching indicator may be configured to receive and engage the latching mechanism 216 coupled to the cable 114. For example, the latching mechanism 216 may comprise locking dogs and/or a collet that engage the latching indicator, which may comprise a corresponding locking profile. The latch mechanism 216 may be configured to engage the landing nipple in response to a weight, an impact, a hydraulic force, a longitudinal motion, a rotational motion, or any combination thereof. Once the latching mechanism 216 engages the landing nipple 110, the sealing mechanism 225 may sealingly engage the landing nipple. The sealing mechanism 225 may be configured to engage the landing nipple in response to a weight, an impact, a hydraulic force, a longitudinal motion, a rotational motion, or any combination thereof. In an embodiment, the sealing mechanism 225 may sealingly engage the landing nipple 110 at the same time that the latch mechanism 216 engages the landing nipple 110, or the sealing mechanism 225 may sealingly engage the landing nipple 110 after the lath mechanism engages the landing nipple 110, which may occur in response to the same or a different input. One or more ports 212 may be formed above the landing nipple 110, which may be a part of the landing nipple 110 or a separate component from the landing nipple 110. The ports 212 may provide fluid communication between the annular flow path 108 and the central flow path 106.

In an embodiment, the cable 114 may comprise an electric line for use in powering a downhole electrical component. In an embodiment, the electrical component may comprise an electric submersible pump, which may be coupled to the cable 114. The cable 114 may also be electrically coupled to a power source at a surface of the well, thereby allowing the downhole electric component to be operated in the wellbore. The work string 120 may also include a landing disposed below the safety valve 102 and the annulus safety valve 104, where the electric submersible pump engages the landing. While described in terms of an electric line and an electric component, it will be appreciated that the safety valve system described herein may be configured to provide a safety valve function even while using a cable deployed through the central flow path 106. Accordingly, the safety valve system described herein may be equally applicable to embodiments in which the cable 114 comprises and/or is substituted with one or more fluid lines or other conduits (e.g., a hydraulic fluid line) passing through the central flow path 106.

In an embodiment, the safety valve control line 222 may be coupled to the safety valve 102. As described above, the safety valve 102 may be configured to provide fluid communication through the safety valve 102 when a control signal (e.g., a fluid pressure, an electrical signal, etc.) is supplied through the safety valve control line 222. Similarly, the annulus safety valve control line 224 may be coupled to the annulus safety valve 104. The annulus safety valve 104 may be configured to provide fluid communication from the central flow path 106 through the annulus safety valve 104 to the annular flow path 108 when a control signal is supplied through the annulus safety valve control line 224. In an embodiment, a single control line may be used to provide a control signal to both the safety valve 102 and the annulus safety valve 104. For example, a single control line may be used to convey a control fluid and/or control signal from the surface of the wellbore to the safety valve system. Individual control lines 222, 224 may then branch off of the single control line to operate the safety valve 102 and the annulus safety valve 104.

In some embodiments, the safety valve 102 and/or the annulus safety valve 104 may be activated without the use of a control signal. For example, the safety valve 102 and/or the annulus safety valve 104 may comprise a foot valve located at or near the end of the work string and activated when the electric component coupled to the cable 114 engages safety valve 102 and/or the annulus safety valve 104, thereby activating the safety valve 102 and/or the annulus safety valve 104 to an open position. Upon removal of the electric component coupled to the cable 114, the safety valve 102 and/or the annulus safety valve 104 would actuate to a closed position.

The safety valve system may be arranged in a variety of configurations to allow for a safety valve function while allowing for the cable 114 to pass through the safety valve 102. In an embodiment as shown in FIG. 2A, the safety valve 102 may be disposed below the annulus safety valve 104. In some embodiments, the safety valve 102 may be disposed above the annulus safety valve 104. In some embodiments, the landing nipple 110 may be coupled to the annulus safety valve 104, though in other embodiments, the landing nipple 110 may be spaced apart from the annulus safety valve 104. The annulus safety valve 104 may be a tubing retrievable safety valve that is coupled to the work string 120 (e.g., above or below a sub containing the safety valve 102).

In an embodiment as shown in FIG. 2B, the downhole electric component may be installed by first disposing the cable 114 within a wellbore tubular string 120 disposed in the wellbore. The cable 114 may comprise an electric line that may be coupled to an electric component on one end and a power source at the opposite end. The electric component may be engaged with a landing disposed below the safety valve 102 and the annulus safety valve 104. The safety valve 102 may be configured in an open position (e.g., due to an applied signal from the safety valve control line 222) when the cable 114 is positioned in the work string 120 to allow the cable and the electric component to pass through the safety valve 102.

The latching mechanism 216 may then be engaged with the landing nipple 110. The landing nipple 110 may also include a landing shoulder and a latching indicator. The latching mechanism 216 may engage the landing shoulder and the latching indicator of the landing nipple 110. For example, the latching mechanism may engage the landing nipple 110 responsive to a weight, an impact, a hydraulic force (e.g., a pressure), a longitudinal motion, a rotational motion, or any combination thereof. In an embodiment, one or more locking dogs and/or a collet with a collet prop may engage the latching indicator in response to a downward weight on the latching mechanism. In an embodiment, a piston or other hydraulic mechanism may be used to engage locking dogs or a collet with the latching indicator. Any other mechanism for engaging an latching mechanism with a landing nipple may also be used. Once engaged, the sealing mechanism may sealingly engage the landing nipple 110 and the cable 114, thereby preventing the flow of fluid past the sealing mechanism on the interior of the work string 120. For example, inflatable sealing elements may be inflated to engage the landing nipple 110 and the cable 114, and/or expanding sealing elements may be expanded against the landing nipple 110 and the cable 114. As shown in FIG. 2A, the annulus safety valve 104 may then be actuated (e.g., due to a control signal from the annulus safety valve control line 224) to an open position in order to produce a fluid from the wellbore.

When both the safety valve 102 and the annulus safety valve 104 are in the open position, producing the fluid from the wellbore may comprise passing the fluid 251 through the central flow path 106, through the annulus safety valve 104, through the one or more ports 252 in the annulus safety valve 104, through the annular flow path 108, through the ports 212, and through the central flow path 106 to the surface of the wellbore. While the cable 114 is disposed within the work string 120, fluid production from the wellbore may be isolated by closing the annulus safety valve 104, for example by reducing the pressure in the annulus safety valve control line 224. As shown in FIG. 2C, the cable 114 and the associated equipment may be removed from the wellbore, and the safety valve 102 may be closed via pivotable movement of closure member 238 to isolate fluid production from the wellbore. As a result, fluid production can be isolated with or without the cable 114 deployed electric component within the wellbore.

In another embodiment illustrated in FIG. 3, the annulus safety valve 304 may comprise a cable retrievable safety valve disposed within the work string 120. In this embodiment, the annulus safety valve 304 may engage the landing nipple 110 within the work string 120. A cable penetrator 301 may comprise a generally cylindrical member having a passageway disposed therethrough for receiving the cable 114. One or more seals may be provided within the passageway to provide a sealing engagement between the inner surface of the cable penetrator 301 and the cable 114. In some embodiments, the cable 114 may be used within the annulus safety valve rather than the cable penetrator 301. Alternatively, the features described herein for the cable penetrator 301 may be considered to be a part of the cable 114 and/or a cable assembly.

The annulus safety valve 304 is disposed about the cable penetrator 301, and the annulus safety valve 304 is configured to sealingly engage the cable penetrator while providing a selective isolation of flow through the annulus safety valve 304. The annulus safety valve 304 generally comprises an outer housing 305, and inner sleeve 306 and a piston 307 disposed therebetween. A first end 302 of the outer housing 305 comprises an inward extension configured to engage a penetrator indicator 303, which may be referred to as a locking profile and may be considered to be a locking profile for the cable 114. A seat or other sealing surface may be provided between the inward extension and the penetrator indicator 303 to provide a seal at the interface 308 between the two components. A retaining sleeve 309 may be disposed about the cable penetrator 301, the penetrator indicator 303, and engage the outer housing 305, for example using a threaded coupling. The retaining sleeve 309 may then maintain the cable penetrator 301 in a substantially fixed engagement with respect to the outer housing 305. One or more ports 312 may be disposed near the inward extension on the first end 302 of the outer housing 305. The retaining sleeve 309 may be slotted, or otherwise formed to allow for fluid communication between an interior flow passage 313 through the interior of the inner sleeve 306 and the central flow path 106 above the annulus safety valve 304. The retaining sleeve 309 may comprise an outer profile configured to engage a corresponding profile on the inner surface of the nipple 110, thereby aligning and retaining the annulus safety valve 304 within the nipple 110.

A second end 314 of the outer housing 305 may be coupled to a lower support 315, using for example, a threaded connection. The lower support 315 may provide a bearing surface for a biasing member 316. In an embodiment, the biasing member 316 comprises a spring, though biasing members other than springs may be utilized without departing from the principles of the present invention. For example, the spring could be replaced by a chamber of compressible gas (e.g., a fluid spring). The lower support 315 may comprise a slotted member to allow fluid communication between the central flow path 106 below the annulus safety valve 304 and the interior flow passage 313 through the interior of the inner sleeve 306.

The inner sleeve 306 comprises a generally tubular member that is slidingly engaged with the piston 307 and the outer housing 305. A first end 317 of the inner sleeve 306 is configured to sealingly engage the inward extension on the first end 302, thereby closing the one or more ports 312. As described in more detail below, the inner sleeve 306 may axially translate out of engagement with the inward extension on the first end 302 to provide fluid communication through the one or more ports 312. A second end of the inner sleeve 306 may comprise a reduced outer diameter relative to a central portion of the inner sleeve, thereby forming a shoulder 318 at the transition between the two portions. The shoulder 318 may engage the biasing member 316.

The piston 307 is sealingly disposed in a chamber between the outer housing 305 and the inner sleeve 306. Seal 321 provides a sealing engagement between the piston 307 and the outer housing 305 while seal 322 provides a sealing engagement between the piston 307 and the inner sleeve 306. Pressure may be applied to the piston via a control line inlet passage 319 in the nipple 110. A control line that may extend to the surface of the earth and may be conventionally secured to the wellbore tubular 120, may be fluidly coupled to the control line inlet passage 319 for providing a control line fluid and pressure to the annulus safety valve 304 through the nipple 110. While passing through the nipple 110, the control line may be considered to be coupled to the annulus safety valve 304 from the surface. Externally and sealingly disposed about the outer housing 305 are a set of circumferential packing rings 310, 311. The packing rings 310, 311 may provide a substantially fluid tight engagement between the annulus safety valve 304 and the nipple 110 when the annulus safety valve 304 is engaged with the nipple 110. The packing rings 310, 311 may be configured to provide a sealing engagement on either side of the control line inlet passage 319, thereby directing a control line fluid through a port 320 in the outer housing 305 and into contact with the piston 307. The piston 307 may then be configured to actuate and axially translate the inner sleeve 306 in response to a fluid pressure sufficient to overcome the force of the biasing member 316.

Figure 3A:
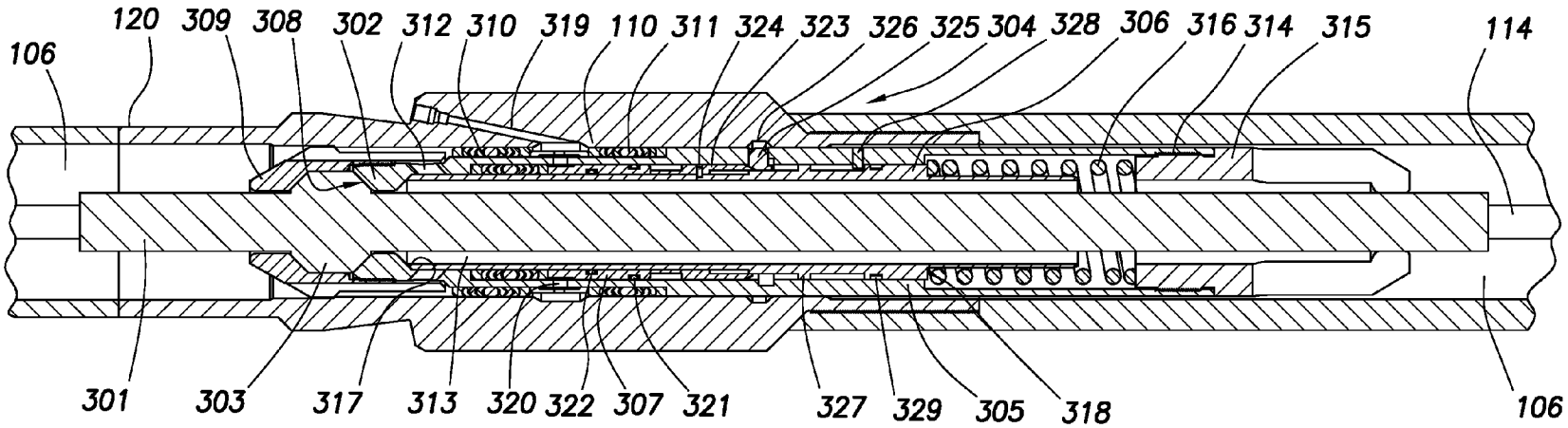
FIGS. 3A-3E illustrate an annulus safety valve according to an embodiment.

FIG. 3A illustrates the configuration of the annulus safety valve 304 in the run-in configuration. In order to engage the annulus safety valve 304 with the nipple 110, the annulus safety valve 304 may be conveyed within the interior of the wellbore tubular 120 until the retaining sleeve engages the profile within the nipple 110, at which point the packing rings 310, 311 may provide a substantially fluid tight engagement between the annulus safety valve 304 and the nipple 110. Fluid pressure may be applied to the annulus safety valve 304 through a control line coupled to the control line inlet passage 319. The fluid pressure may act upon and force the piston 307 downward with respect to the outer housing 305. The piston 307 may engage a lug prop 323, which may comprise a shear device 324 (e.g., a shear pin, shear screw, shear ring, etc.). Upon the application of a sufficient pressure, the shear device 324 may fail, thereby allowing the lug prop 323 to shift downward. When the lug prop 323 shifts a sufficient distance, the lug prop 323 may engage and shift below one or more lugs 325, which may force the lugs 325 radially outward into a corresponding lug profile 326 in the nipple 110. The engagement of the lugs 325 within the lug profile 326 may axially lock the annulus safety valve 304 to the nipple 110. The continued translation of the piston 307 may force the lug prop 323 to translate downward until engaging a flange 327. Further movement of the piston may then be transferred through the lug prop 323 to the flange 327, and thereby the inner sleeve 306. Once the shear device 324 has been sheared and the lug prop 323 has been shifted, the annulus safety valve 304 may be considered to be in the operating state.

Figure 3B:
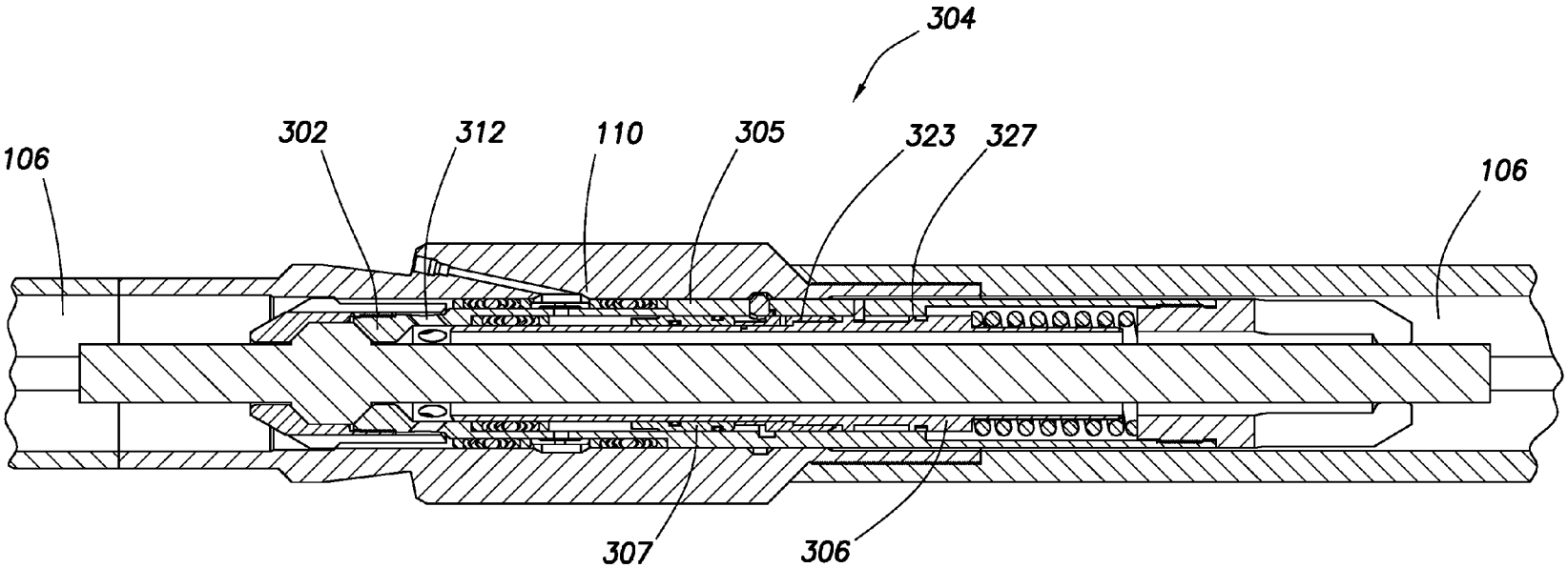
Figure 3C:
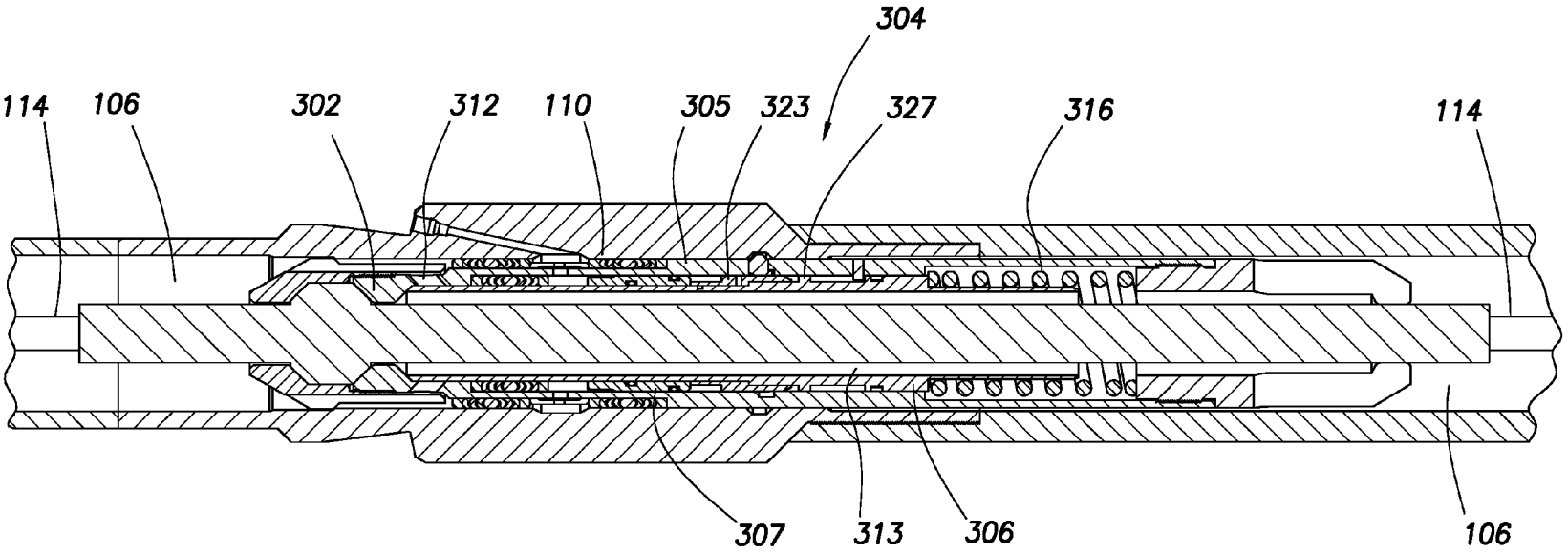

Once in the operating state as shown in FIGS. 3B and 3C, the application of fluid pressure to the piston 307 may axially displace the piston downward, which through the engagement with the lug prop 323 and the flange 327, may translate the inner sleeve 306 downward. As the inner sleeve 306 translates downward, the inner sleeve 306 may translate out of engagement with the inward extension of the first end 302 of the outer housing 305, thereby allowing for fluid communication through the ports 312. In this configuration, the annulus safety valve is considered to be "open" and allows for fluid flow from the central flow path 106 below the annulus safety valve 304, through the interior flow passage 313, through the ports 312, and back via groves 331 (FIG. 3E) into the central flow path 106 above the annulus safety valve 304.

As illustrated in FIG. 3C, the annulus safety valve may be configured in the "closed" position when the control line pressure is released, or is otherwise insufficient to overcome the biasing force of the biasing member 316. In this configuration, the inner sleeve 306 is axially translated upward to engage the inward extension on the first end 302 of the outer housing 305, thereby forming a sealing engagement to prevent the flow of fluids through the ports 312.

Figure 3D:
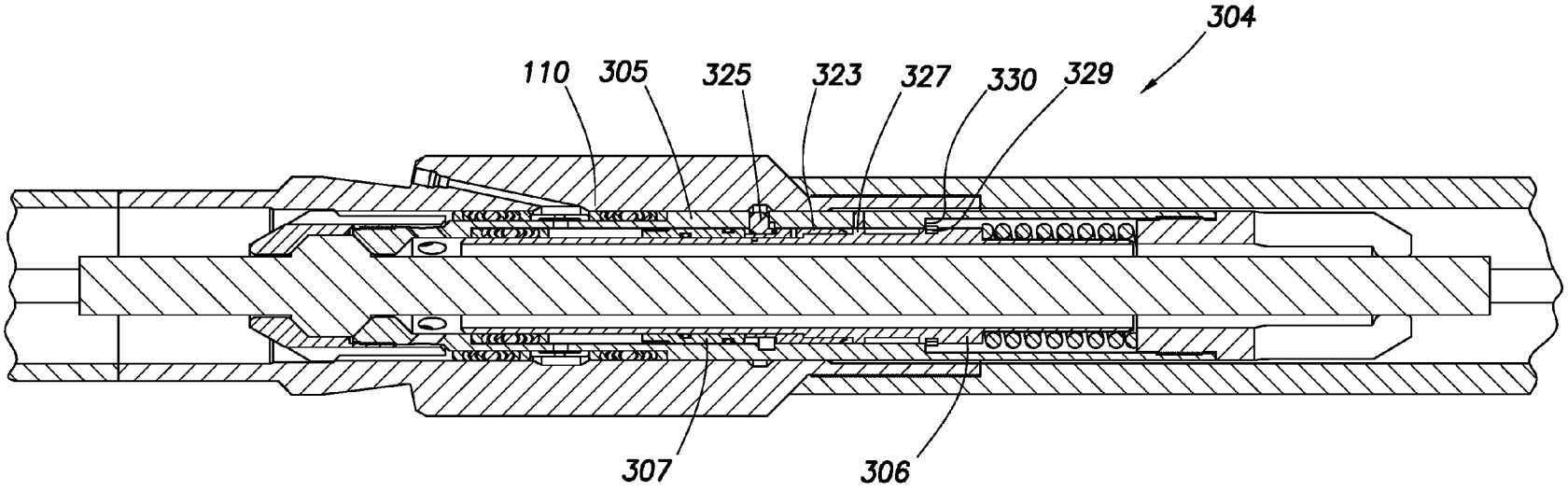
Figure 3E:
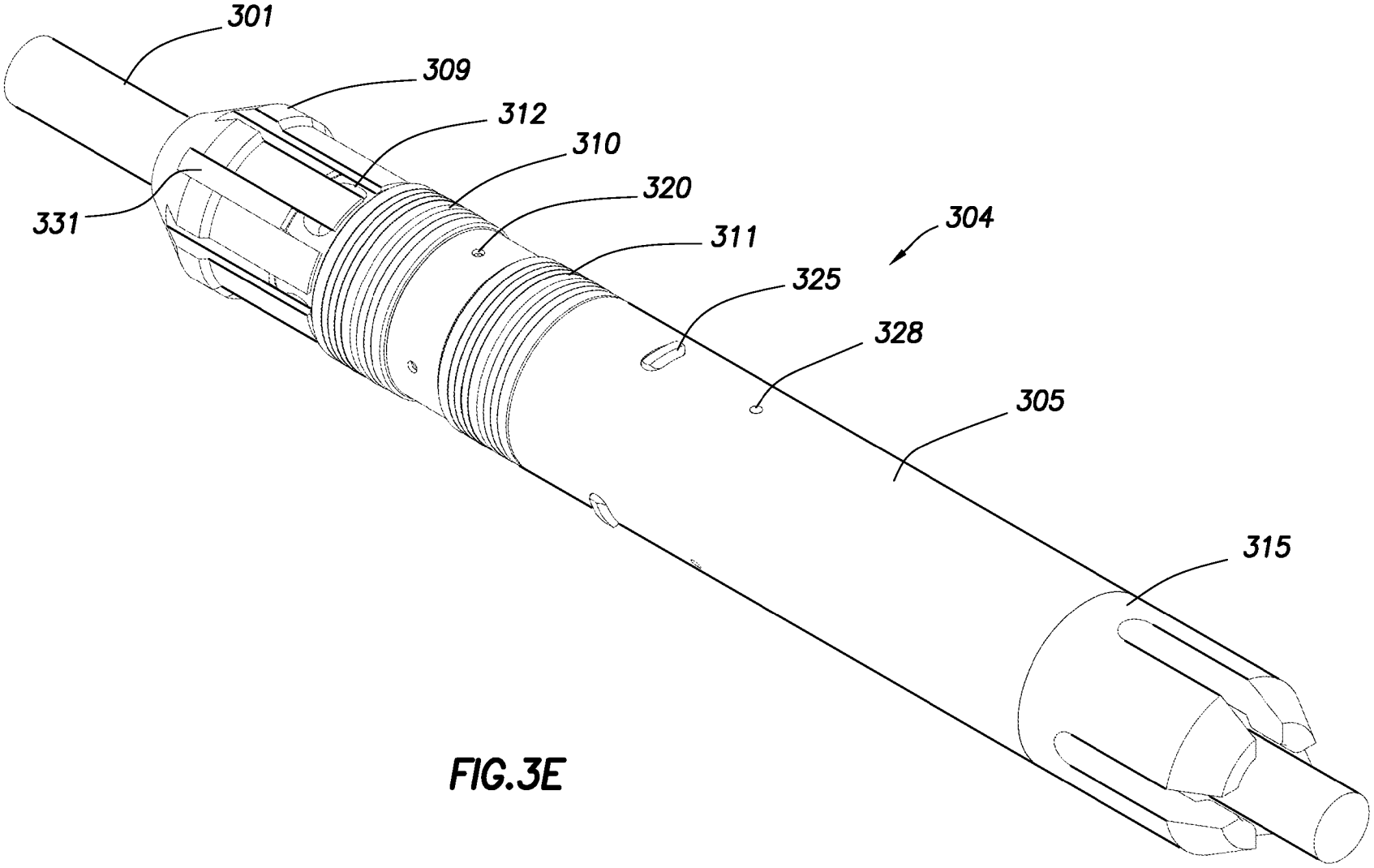

When the annulus safety valve 304 is to be removed from the wellbore, for example to remove and/or repair the downhole component coupled to the cable 114, an overpressure may be applied to the annulus safety valve 304 through the control line inlet port 319. Referring to FIGS. 3A and 3D, pressure may be applied to the piston 307 to force the piston 307 downward. A second shear device 328 may then engage the flange 327. In the operating state, this engagement may act as a limit on the downward movement of the inner sleeve 306. When a sufficient pressure is applied to the piston, the second shear device 328 may fail, thereby allowing the piston 307, the lug prop 323, and the inner sleeve 306 to axially translate downward until a retaining ring 329 passes a shoulder 330 on the outer housing 305. The retaining ring 329 (e.g., a c-ring, split ring, etc.) may expand outward while maintaining an engagement with the inner sleeve 306. The outward expansion of the retaining ring 329 may prevent the inner sleeve 306 from translating upward. In this configuration, the lug prop 323 may be translated past the lug 325 so that a recess may be radially aligned with the lug 325, thereby allowing the lug 325 to radially translate inward and out of engagement with the nipple 110. Once the lug 325 is released from the nipple 110, the annulus safety valve 304 may be translated within the wellbore and/or removed as needed.

As a result of the annulus safety valve 304 being located within work string 120, a separate safety valve may not be needed in this embodiment. Rather, the annulus safety valve 304 may be used to isolate the flow of fluids within the wellbore. In some embodiments, the annulus safety valve 304 may be used with a safety valve 102 comprising a foot valve located at or near the end of the work string 120 and activated using the electric component coupled to the cable 114.

In the embodiment illustrated in FIGS. 3A-3E, the annulus safety valve 304 and cable 114 may be disposed in the work string 120 using a similar procedure to the one described above. First, the downhole electric component may be installed by first disposing the annulus safety valve 304 coupled to the cable 114 within a wellbore tubular string 120 disposed in a wellbore. The cable 114 may comprise an electric line that may be coupled to an electric component on one end and a power source at the opposite end. The electric component may be engaged with a landing disposed below the safety valve 102 and the annulus safety valve 304. The safety valve 102 may be configured in an open position (e.g., due to an applied signal from the safety valve control line 222) when the cable 114 is positioned in the work string 120 to allow the cable 114 and the electric component to pass through the safety valve 102.

The lugs 325 on the annulus safety valve 304 may then be engaged with the landing nipple 110 as described above. While described as engaging the annulus safety valve 304 with the nipple 110 in response to a pressure, the annulus safety valve may engage the landing nipple 110 responsive to a weight, an impact, a hydraulic force, a longitudinal motion, a rotational motion, or any combination thereof. Once engaged, the flow of fluid past the annulus safety valve 304 may then be controlled using the inner sleeve 306 and the ports 312 in the annulus safety valve 304. The annulus safety valve 304 may then be actuated to an open position in order to produce a fluid from the wellbore.

When both the safety valve 102 and the annulus safety valve 304 are in the open position, producing the fluid from the wellbore may comprise passing the fluid through the central flow path 106, through the annulus safety valve ports 312, and through the central flow path 106 above the annulus safety valve 304 to the surface of the wellbore. Fluid production from the wellbore may be isolated by closing the ports 312 in the annulus safety valve 304, for example by reducing the control pressure supplied to the annulus safety valve 304. The cable 114 and the associated equipment may be removed from the wellbore, and the safety valve 102 may be closed to isolate fluid production from the wellbore. As a result, fluid production can be isolated with or without the cable deployed electric component within the wellbore.

Having described the systems and methods, various embodiments may include, but are not limited to:

1. In an embodiment, a safety valve system for downhole use in a wellbore comprises a safety valve comprising a sealable flow path; an annulus safety valve configured to provide fluid communication between a central flow path and an annular flow path; a landing nipple, wherein the landing nipple comprises ports configured to provide fluid communication between the annular flow path and the central flow path; and a cable passing through the sealable flow path, wherein the cable comprises a sealing mechanism and latch mechanism configured to engage the landing nipple.

2. The safety valve system of embodiment 1, wherein the annular flow path comprises a flow path between an outer wellbore tubular and the safety valve system.

3. The safety valve system of embodiment 1 or 2, wherein the safety valve is disposed below the annulus safety valve.

4. The safety valve system of embodiment 1 or 2, wherein the safety valve is disposed above the annulus safety valve.

5. The safety valve system of any of embodiments 1-4, wherein the landing nipple is coupled to the annulus safety valve.

6. The safety valve system of any of embodiments 1-4, wherein the cable comprises an electric line.

7. The safety valve system of embodiment 6, further comprising an electric submersible pump coupled to the cable.

8. The safety valve system of embodiment 6 or 7, wherein the cable is electrically coupled to a power source at a surface of the wellbore.

9. The safety valve system of any of embodiments 6-8, further comprising a landing disposed below the safety valve and the annulus safety valve, wherein the electric submersible pump engages the landing.

10. The safety valve system of any of embodiments 1-9, wherein the latch mechanism is configured to engage the landing nipple responsive to a weight, an impact, a hydraulic force, a longitudinal motion, a rotational motion, or any combination thereof.

11. The safety valve system of any of embodiments 1-10, wherein the landing nipple further comprises a landing shoulder and a latching indicator.

12. The safety valve system of embodiment 11, wherein the latching mechanism engages the landing shoulder and the latching indicator of the landing nipple.

13. The safety valve system of any of embodiments 1-12, wherein the sealing mechanism sealingly engages the landing nipple.

14. The safety valve system of any of embodiments 1-13, wherein the safety valve comprises a sealing element.

15. The safety valve system of embodiment 14, wherein the sealing element comprises a flapper for engaging a corresponding flapper seal, a ball for engaging a ball valve seat, a gate for engaging a gate valve seat, or a sleeve slidingly disposed within a window.

16. The safety valve system of any of embodiments 1-15, wherein the annulus safety valve is a tubing retrievable safety valve.

17. The safety valve system of any of embodiments 1-16, further comprising a safety valve control line coupled to the safety valve.

18. The safety valve system of embodiment 17, wherein the safety valve is configured to provide fluid communication through the safety valve when a control pressure is supplied through the safety valve control line.

19. The safety valve system of any of embodiments 1-18, further comprising an annulus safety valve control line coupled to the annulus safety valve.

20. The safety valve system of embodiment 19, wherein the annulus safety valve is configured to provide fluid communication from the central flow path through the annulus safety valve to the annular flow path when a control pressure is supplied through the annulus safety valve control line.

21. In an embodiment, a safety valve system for downhole use in a wellbore comprises a safety valve comprising a sealable flow path; a landing nipple comprising a locking profile; an annulus safety valve engaging the locking profile; and an annulus safety valve control line coupled to the annulus safety valve.

22. The safety valve system of embodiment 21 further comprising a cable passing through the sealable flow path and the annulus safety valve, wherein the cable comprises a sealing mechanism and latch mechanism configured to sealingly engage the annulus safety valve.

23. The safety valve system of embodiment 21 or 22, wherein the safety valve is disposed below the annulus safety valve.

24. The safety valve system of embodiment 21 or 22, wherein the safety valve is disposed above the annulus safety valve.

25. The safety valve system of any of embodiments 21-24, wherein the landing nipple is coupled to the annulus safety valve.

26. The safety valve system of any of embodiments 21-23, wherein the cable comprises an electric line.

27. The safety valve system of embodiment 26, further comprising an electric submersible pump coupled to the cable.

28. The safety valve system of embodiment 26 or 27, wherein the cable is electrically coupled to a power source at a surface of the wellbore.

29. The safety valve system of any of embodiments 26-28, further comprising a landing disposed below the safety valve and the annulus safety valve, wherein the electric submersible pump engages the landing.

30. The safety valve system of any of embodiments 21-28, wherein the annulus safety valve comprises a latch mechanism for engaging the locking profile, wherein the latch mechanism is configured to engage the locking profile responsive to a weight, an impact, a hydraulic force, a longitudinal motion, a rotational motion, or any combination thereof.

31. The safety valve system of any of embodiments 21-30, wherein the landing nipple further comprises a landing shoulder.

32. The safety valve system of any of embodiments 21-31, wherein the safety valve comprises a sealing element.

33. The safety valve system of embodiment 32, wherein the sealing element comprises a flapper for engaging a corresponding flapper seal, a ball for engaging a ball valve seat, a gate for engaging a gate valve seat, or a sleeve slidingly disposed within a window.

34. The safety valve system of any of embodiments 21-33, wherein the annulus safety valve is a cable retrievable safety valve.

35. The safety valve system of any of embodiments 21-34, further comprising a safety valve control line coupled to the safety valve.

36. The safety valve system of embodiment 35, wherein the safety valve is configured to provide fluid communication through the safety valve when a control pressure is supplied through the safety valve control line.

37. The safety valve system of any of embodiments 21-36, further comprising an annulus safety valve control line coupled to the annulus safety valve.

38. The safety valve system of embodiment 37, wherein the annulus safety valve is configured to provide fluid communication from the central flow path through the annulus safety valve to the annular flow path when a control pressure is supplied through the annulus safety valve control line.

39. In an embodiment, a method comprises disposing a cable within a wellbore tubular string disposed in a well, and producing a fluid from the wellbore. The wellbore tubular string comprises: a safety valve comprising a sealable flow path; an annulus safety valve configured to provide fluid communication between a central flow path and an annular flow path; and a landing nipple, wherein the landing nipple comprises ports configured to provide fluid communication between the annular flow path and the central flow path, and wherein the cable comprises a sealing mechanism and latch mechanism configured to engage the landing nipple.

40. The method of embodiment 39, wherein producing the fluid from the wellbore comprises passing the fluid through the central flow path, through the annulus safety valve, through the annular flow path, through the ports, and through the central flow path to the surface of the wellbore.

41. The method of embodiment 39 or 40, wherein the annular flow path comprises a flow path between an outer wellbore tubular and the safety valve system.

42. The method of any of embodiments 39-41, wherein the safety valve is disposed above the annulus safety valve.

43. The method of any of embodiments 39-41, wherein the landing nipple is coupled to the annulus safety valve.

44. The method of any of embodiments 39-43, wherein the cable comprises an electric line.

45. The method of embodiment 44, further comprising coupling an electric submersible pump coupled to the cable.

46. The method of embodiment 44 or 45, wherein the cable is electrically coupled to a power source at a surface of the wellbore.

47. The method of embodiments 45 or 46, further comprising engaging the electric submersible pump with a landing disposed below the safety valve and the annulus safety valve.

48. The method of any of embodiments 39-47, wherein the latch mechanism engages the landing nipple responsive to a weight, an impact, a hydraulic force, a longitudinal motion, a rotational motion, or any combination thereof.

49. The method of any of embodiments 39-48, wherein the landing nipple further comprises a landing shoulder and a latching indicator.

50. The method of embodiment 49, wherein the latching mechanism engages the landing shoulder and the latching indicator of the landing nipple.

51. The method of any of embodiments 39-50, wherein the sealing mechanism sealingly engages the landing nipple.

52. The method of any of embodiments 39-51, wherein the safety valve comprises a sealing element.

53. The method of embodiment 52, wherein the sealing element comprises a flapper for engaging a corresponding flapper seal, a ball for engaging a ball valve seat, a gate for engaging a gate valve seat, or a sleeve slidingly disposed within a window.

54. The method of any of embodiments 39-53, wherein the annulus safety valve is a tubing retrievable safety valve.

55. The method of any of embodiments 39-54, wherein the wellbore tubular string further comprises a safety valve control line coupled to the safety valve.

56. The method of embodiment 55, further comprising: providing a control pressure through the safety valve control line to open the safety valve.

57. The method of any of embodiments 39-56, wherein the wellbore tubular string further comprises an annulus safety valve control line coupled to the annulus safety valve.

58. The method of embodiment 57, further comprising: providing a control pressure through the safety valve control line to open the safety valve.

59. The method of embodiment 57 or 58, further comprising isolating a first portion of the wellbore above the annulus safety valve from a second portion of the wellbore below the annulus safety valve.

60. The method of embodiment 59, wherein the isolating comprises reducing the pressure in the annulus safety valve control line.

61. In an embodiment, a method comprises disposing a cable within a wellbore tubular string disposed in a well, wherein the cable comprises an annulus safety valve coupled to the cable, wherein the wellbore tubular string comprises: a landing nipple comprising a locking profile and a port, wherein the port is operable between an open position and closed position; engaging the annulus safety valve with the locking profile; and producing a fluid from the wellbore.

62. The method of embodiment 61, wherein the wellbore tubular string further comprises a safety valve comprising a sealable flow path, wherein cable is disposed within the sealable flow path upon engaging the annulus safety valve with the locking profile.

63. The method of embodiment 61 or 62, wherein engaging the annulus safety valve with the locking profile comprises forming a sealing engagement between the annulus safety valve and the locking profile.

64. The method of any of embodiments 61-63, wherein the safety valve is disposed below the annulus safety valve.

65. The method of any of embodiments 61-63, wherein the safety valve is disposed above the annulus safety valve.

66. The method of any of embodiments 61-65, wherein the landing nipple further comprises a honed bore.

67. The method of any of embodiments 61-66, wherein the cable comprises an electric line.

68. The method of embodiment 67, further comprising coupling an electric submersible pump coupled to the cable.

69. The method of embodiment 67 or 68, wherein the cable is electrically coupled to a power source at the surface of the wellbore.

70. The method of embodiment of embodiment 68 or 69, further comprising engaging the electric submersible pump with a landing disposed below the safety valve and the annulus safety valve.

71. The method of any of embodiments 61-70, wherein the annulus safety valve comprises a latch mechanism for engaging the locking profile, and wherein engaging the annulus safety valve with the locking profile comprises engaging the locking profile responsive to a weight, an impact, a hydraulic force, a longitudinal motion, a rotational motion, or any combination thereof.

72. The method of any of embodiments 61-70, wherein the landing nipple further comprises a landing shoulder.

73. The method of any of embodiments 61-72, wherein the safety valve comprises a sealing element.

74. The method of embodiment 73, wherein the sealing element comprises a flapper for engaging a corresponding flapper seal, a ball for engaging a ball valve seat, a gate for engaging a gate valve seat, or a sleeve slidingly disposed within a window.

75. The method of any of embodiments 61-74, wherein the annulus safety valve is a cable retrievable safety valve.

76. The method of any of embodiments 61-75, wherein the wellbore tubular string further comprises a safety valve control line coupled to the safety valve.

77. The method of embodiment 76, further comprising: providing a control pressure through the safety valve control line to open the safety valve.

78. The method of any of embodiments 61-77, wherein the wellbore tubular string further comprises an annulus safety valve control line coupled to the annulus safety valve.

79. The method of embodiment 78, further comprising: providing a control pressure through the safety valve control line to open the safety valve.

80. The method of embodiment 78 or 79, further comprising isolating a first portion of the wellbore above the annulus safety valve from a second portion of the wellbore below the annulus safety valve.

81. The method of embodiment 80, wherein the isolating comprises reducing the pressure in the annulus safety valve control line.

At least one embodiment is disclosed and variations, combinations, and/or modifications of the embodiment(s) and/or features of the embodiment(s) made by a person having ordinary skill in the art are within the scope of the disclosure. Alternative embodiments that result from combining, integrating, and/or omitting features of the embodiment(s) are also within the scope of the disclosure. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, $R_l$, and an upper limit, $R_u$, is disclosed, any number falling within the range is specifically disclosed. In particular, the following numbers within the range are specifically disclosed: $R=R_l+k*(R_u-R_l)$, wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim means that the element is required, or alternatively, the element is not required, both alternatives being within the scope of the claim. Use of broader terms such as comprises, includes, and having should be understood to provide support for narrower terms such as consisting of, consisting essentially of, and comprised substantially of. Accordingly, the scope of protection is not limited by the description set out above but is defined by the claims that follow, that scope including all equivalents of the subject matter of the claims. Each and every claim is incorporated as further disclosure into the specification and the claims are embodiment(s) of the present invention.

What is claimed is:

1. A safety valve system for downhole use in a wellbore comprising:

a safety valve comprising a sealable flow path;

an annulus safety valve configured to provide fluid communication between a central flow path and an annular flow path;

a landing nipple, wherein the landing nipple comprises ports configured to provide fluid communication between the annular flow path and the central flow path; and a cable passing through the sealable flow path, wherein the cable comprises a sealing mechanism and latch mechanism configured to engage the landing nipple wherein the sealing mechanism is further configured to prevent the flow of a fluid past the sealing mechanism in the central flow path.

2. The safety valve system of claim 1, wherein the annular flow path comprises a flow path between an outer wellbore tubular and a work string.

3. The safety valve system of claim 1, wherein the safety valve is disposed below the annulus safety valve.

4. The safety valve system of claim 1, wherein the landing nipple is coupled to the annulus safety valve.

5. The safety valve system of claim 1, wherein the cable comprises an electric line.

6. The safety valve system of claim 5, further comprising an electric submersible pump coupled to the cable.

7. The safety valve system of claim 5, wherein the cable is electrically coupled to a power source at a surface of the wellbore.

8. The safety valve system of claim 1, wherein the safety valve comprises a sealing element, and wherein the sealing element comprises a flapper for engaging a corresponding flapper seal, a ball for engaging a ball valve seat, a gate for engaging a gate valve seat, or a sleeve slidingly disposed within a window.

9. A method comprising:

disposing a cable within a wellbore tubular string disposed in a well, wherein the wellbore tubular string comprises:

a safety valve comprising a sealable flow path;

an annulus safety valve configured to provide fluid communication between a central flow path and an annular flow path; and a landing nipple, wherein the landing nipple comprises ports configured to provide fluid communication between the annular flow path and the central flow path, and wherein the cable comprises a sealing mechanism and latch mechanism configured to engage the landing nipple, wherein the sealing mechanism is further configured to prevent the flow of a fluid past the sealing mechanism in the central flow path; and producing a fluid from the wellbore.

10. The method of claim 9, wherein producing the fluid from the wellbore comprises passing the fluid through the central flow path, through the annulus safety valve, through the annular flow path, through the ports, and through the central flow path to the surface of the wellbore.

11. The method of claim 9, further comprising coupling an electric submersible pump to the cable.

12. The method of claim 9, wherein the landing nipple further comprises a landing shoulder and a latching indicator.

13. The method of claim 12, wherein the latching mechanism engages the landing shoulder and the latching indicator of the landing nipple.

14. The method of claim 9, further comprising isolating a first portion of the wellbore above the annulus safety valve from a second portion of the wellbore below the annulus safety valve.

* * * * *